US010563829B2

(12) United States Patent
Bobbo et al.

(10) Patent No.: US 10,563,829 B2
(45) Date of Patent: Feb. 18, 2020

(54) FASTENING DEVICE AND A SYSTEM FOR FASTENING LIGHTING DEVICES TO A FALSE CEILING

(71) Applicant: OSRAM GmbH, Munich (DE)

(72) Inventors: Simon Bobbo, Padua (IT); Valerio Michielan, Gardigiano (IT)

(73) Assignee: OSRAM GMBH, Munich (DE)

( * ) Notice: Subject to any disclaimer, the term of this patent is extended or adjusted under 35 U.S.C. 154(b) by 0 days.

(21) Appl. No.: 16/116,984

(22) Filed: Aug. 30, 2018

(65) Prior Publication Data

US 2019/0072249 A1 Mar. 7, 2019

(30) Foreign Application Priority Data

Sep. 6, 2017 (IT) ..... 102017000100057

(51) Int. Cl.

| | |
|---|---|
| ***F21S 8/04*** | (2006.01) |
| ***F21V 23/00*** | (2015.01) |
| ***E04B 9/00*** | (2006.01) |
| ***F21V 23/06*** | (2006.01) |
| ***F21V 21/088*** | (2006.01) |
| ***E04B 9/06*** | (2006.01) |
| ***E04B 9/24*** | (2006.01) |
| ***F21V 21/002*** | (2006.01) |
| *F21V 21/04* | (2006.01) |
| *F21V 33/00* | (2006.01) |

(52) U.S. Cl.

CPC ..... *F21S 8/043* (2013.01); *E04B 9/006* (2013.01); *E04B 9/068* (2013.01); *E04B 9/241* (2013.01); *F21S 8/04* (2013.01); *F21V 21/002* (2013.01); *F21V 21/088* (2013.01); *F21V 23/001* (2013.01); *F21V 23/06* (2013.01); *F21V 21/048* (2013.01); *F21V 33/006* (2013.01)

(58) Field of Classification Search

CPC ..... E04B 9/006; E04B 9/067; E04B 9/068; E04B 9/065; F21S 8/043; F21V 21/002; F21V 21/088; F21V 21/104; F21V 21/048

See application file for complete search history.

(56) References Cited

U.S. PATENT DOCUMENTS 8,584,412 B2 * 11/2013 Frecska ..... E04B 9/006 52/220.6

2010/0130055 A1 5/2010 Liang et al.

FOREIGN PATENT DOCUMENTS

WO 2006124539 A2 11/2006
WO 2010071681 A1 6/2010

OTHER PUBLICATIONS

Italian Search Report based on application No. 102017000100057 (6 pages) dated Mar. 20, 2018 (for reference purpose only).

* cited by examiner

*Primary Examiner* — Ross N Gushi

(74) *Attorney, Agent, or Firm* — Viering, Jentschura & Partner MBB

(57) ABSTRACT

A fastening device for fastening lighting devices to T-shaped profiles of a false ceiling. The fastening device may include a shaped flat body of electrically insulating material having conductive tracks embedded therein. The conductive tracks may have first ends and second ends that protrude from opposite ends of the flat body. The conductive tracks may be configured for establishing an electrical connection between a lighting device and a power supply source located above the false ceiling.

11 Claims, 5 Drawing Sheets

FASTENING DEVICE AND A SYSTEM FOR FASTENING LIGHTING DEVICES TO A FALSE CEILING

CROSS REFERENCE TO RELATED APPLICATION

This present application claims priority to Italian Patent Application No. 102017000100057 filed on Sep. 6, 2017; which is incorporated by reference herein in its entirety and for all purposes.

TECHNICAL FIELD

The present description refers to lighting devices.

One or more embodiments may refer to the assembly of lighting devices to a false ceiling.

One or more embodiments may concern a fastening device for fastening lighting devices to a false ceiling.

TECHNOLOGICAL BACKGROUND

A false ceiling is a building construction with a light-weight structure placed under the ceiling of a building, which results in a decrease in the useful height of the room concerned. The false ceiling can be made to meet aesthetic requirements and to form a covering with heat-insulating, sound-absorbing or fire-resistant material. The false ceiling can also be used to house one or more systems in the compartment created between the false ceiling and the ceiling. The most typical system housed in the false ceiling is a lighting system.

The most widespread false ceiling structure envisages the use of a grid-shaped metal structure comprising a plurality of inverted T-shaped profiles, which can be fastened to the ceiling of the building by means of suspension wires. A false ceiling generally comprises a plurality of panels, for example, square-shaped, having edges that can rest on lower horizontal wings of the T-shaped profiles of the false ceiling structure.

One of the most widespread solutions for installing a lighting system in a false ceiling envisages the use of panel-shaped lighting fixtures that are inserted in place of the respective false ceiling panels and that exactly occupy the space of a false ceiling panel.

An alternative lighting system, which is increasingly being used in the market, can envisage the use of linear lighting devices that replace corresponding sections of T-shaped profiles. A solution of this type can allow better integration from an aesthetic point of view of the lighting system in the false ceiling structure, since the lighting devices do not replace the false ceiling panels. However, this solution may involve installation difficulties due to the fact that it may be necessary to remove sections of the false ceiling supporting structure for assembling linear lighting devices.

In addition to assembly problems, a further aspect to consider is the electrical connection of the lighting devices to the electrical network. When the lighting devices replace a part of the false ceiling structure (false ceiling panels or sections of the T-shaped profiles), the electrical connections can be made on the upper part of the false ceiling.

However, in cases where the lighting fixtures do not replace portions of the false ceiling structure (e.g. lighting devices suspended by wires), it may be necessary to provide holes in the false ceiling structure for passing the electrical power supply cables.

OBJECT AND SUMMARY

One or more embodiments intend to contribute to overcoming the drawbacks outlined above.

More specifically, one or more embodiments aim to provide a fastening device for fastening lighting devices to a false ceiling structure, which can provide both the mechanical fastening of the lighting devices to the false ceiling supporting structure and the power supply.

According to one or more embodiments, these objects can be achieved by a device having the characteristics referred to in the following claims.

In one or more embodiments, the fastening device can provide, in a single component:

- the electrical connection between the lighting device and the power source; and
- the mechanical fastening of the lighting device to the T-shaped profiles of the false ceiling structure.

BRIEF DESCRIPTION OF THE FIGURES

One or more embodiments will be now described, purely by way of non-limiting example, with reference to the attached figures, wherein.

DETAILED DESCRIPTION

In the following description, various specific details are illustrated aimed at a thorough understanding of examples of one or more embodiments. The embodiments can be implemented without one or more of the specific details, or with other methods, components, materials, etc. In other cases, known structures, materials, or operations are not shown or described in detail to avoid obscuring various aspects of the embodiments. The reference to "an embodiment" in the context of this description indicates that a particular configuration, structure or characteristic described in relation to the embodiment is included in at least one embodiment. Therefore, phrases such as "in an embodiment", possibly present in different places of this description do not necessarily refer to the same embodiment. Moreover, particular conformations, structures or characteristics can be combined in a suitable manner in one or more embodiments and/or associated with the embodiments in a different way from that illustrated here, for example, a characteristic exemplified here in relation to a figure may be applied to one or more embodiments exemplified in a different figure.

The references illustrated here are only for convenience and do not, therefore, delimit the field of protection or the scope of the embodiments.

Figure 1:
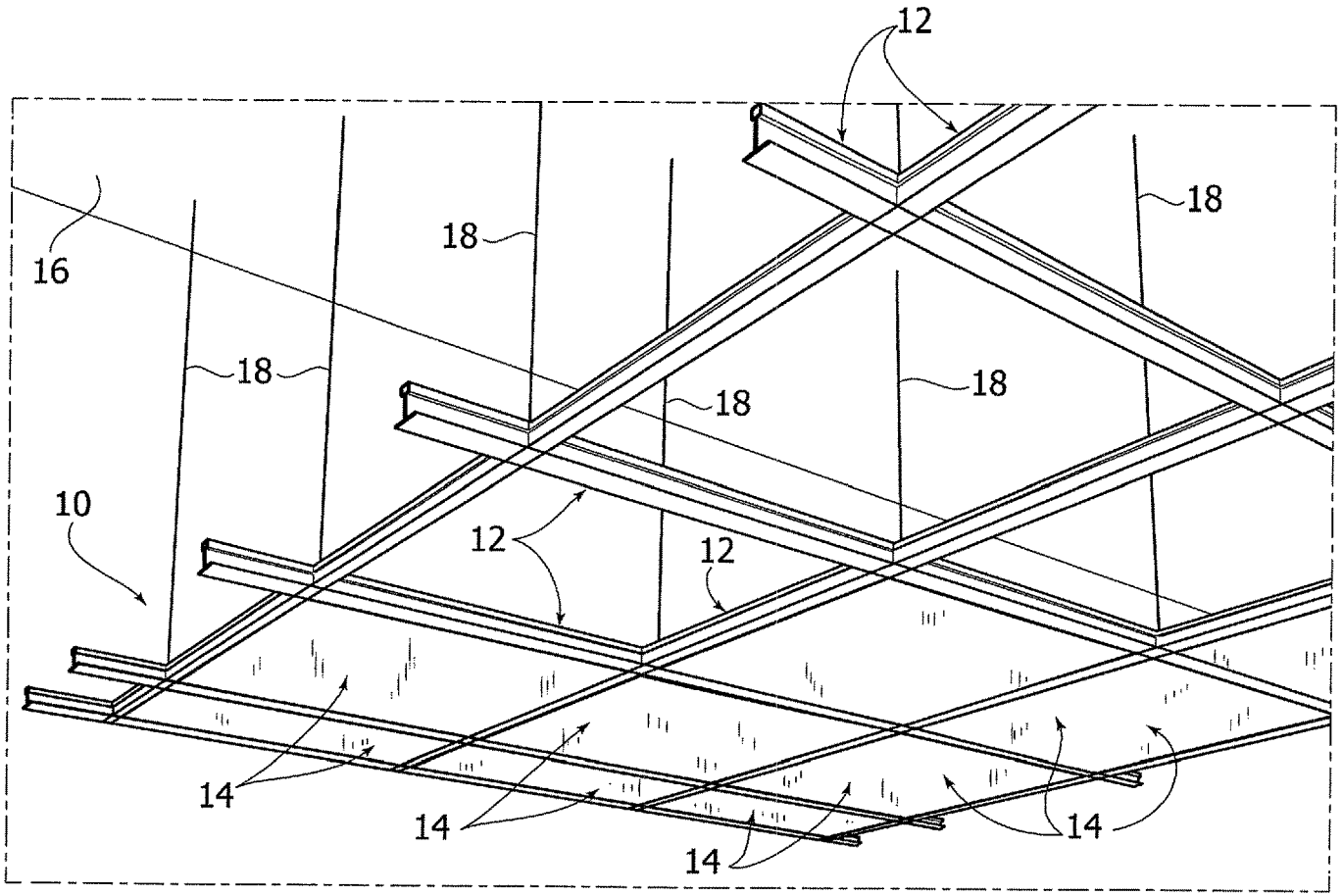
FIG. 1 is a perspective view illustrating a part of a false ceiling.

In FIG. 1, the reference 10 indicates a false ceiling of a building. The false ceiling 10 can comprise a grid-shaped supporting structure including a plurality of T-shaped profiles 12 and a plurality of false-ceiling panels 14, for example square-shaped, whose edges rest on the lower horizontal wings of the T-shaped profiles 12. The T-shaped profiles 12 can be fastened to a ceiling 16 of the building, for example, by means of suspension wires 18.

Figure 2:
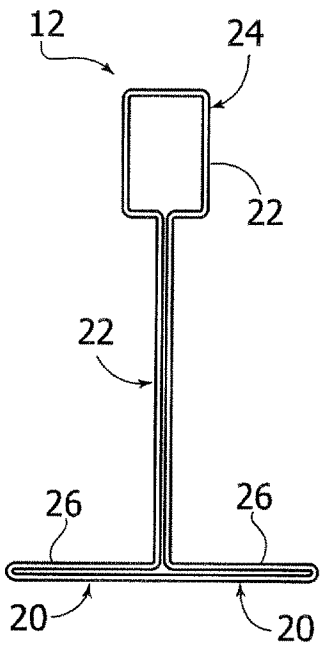
FIG. 2 is an enlarged cross-section illustrating a T-shaped profile of the false ceiling structure.

With reference to FIG. 2, the T-shaped profiles 12 may have an inverted T-shaped cross-section. The T-shaped profiles 12 may have horizontal wings 20 protruding from opposite sides of a vertical central rib 22. The T-shaped profiles 12 may be provided with upper heads 24. The lower horizontal wings 20 of the T-shaped profiles 12 may have upper surfaces 26 on which edges of false-ceiling panels 14 can rest.

In the present description the geometric references such as, for example, horizontal, vertical, lower, upper, etc. refer to the position of normal use in a false ceiling and do not intend to limit the scope of application of the embodiments.

Figure 4:
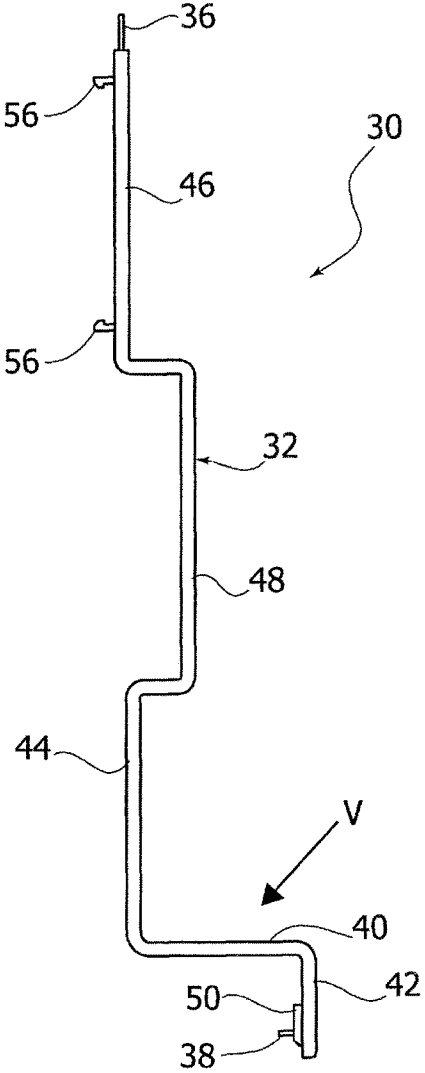
FIG. 4 is a side view according to the arrow IV of FIG. 3.
Figure 3:
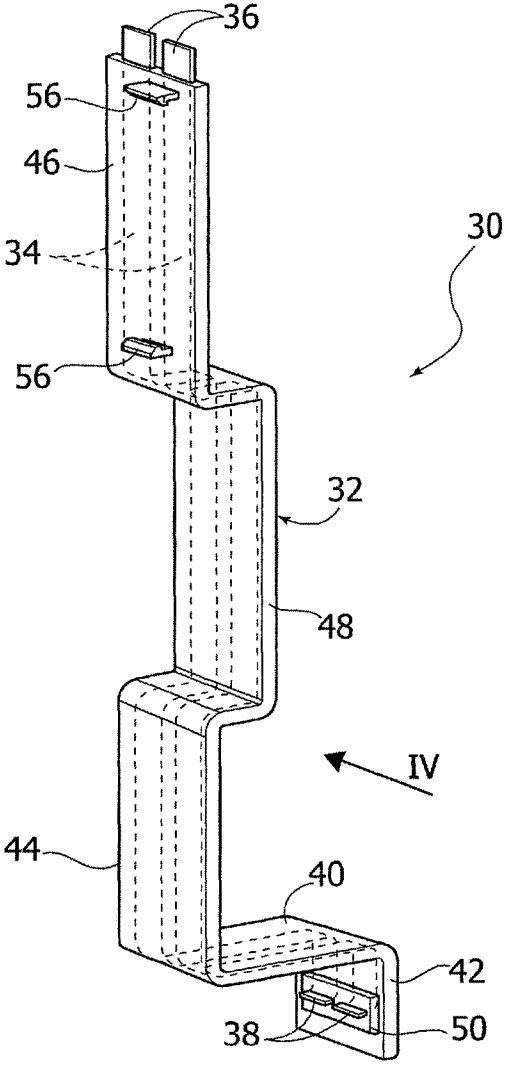
FIG. 3 is a perspective view illustrating an embodiment of a fastening device for fastening a linear lighting device to a false ceiling structure.

With reference to FIGS. 3 and 4, the reference 30 indicates a fastening device for fastening lighting devices, for example linear, to a false ceiling structure. The fastening device 30 may comprise a shaped flat body 32 of electrically-insulating material, for example of plastic material, within which electrically conductive tracks 34, for example copper, can be embedded. In order to minimize the thickness of the body 32, the electrically conductive tracks 34 can be ultra-thin copper lamellae. The conductive tracks 34 may be embedded into the body of electrically-insulating material 32 by a co-molding method. Alternatively, the conductive tracks 34 may be enclosed between two thin shells of plastic material welded together.

In one or more embodiments the conductive tracks 34 may have first ends 36 and second ends 38 protruding from respective ends of the body 32. In one or more embodiments, the ends 36, 38 of the conductive tracks 34 can be used for the electrical connection of the fastening device to a power supply source located above the false ceiling, and to a lighting device, respectively. The first ends 36 of the conductive tracks 34, in use, may be located above the false ceiling panels 14 and can be used for electrical connection of the fastening device 30 to a power supply source. The connection to the power supply source of the first ends 36 of the conductive tracks 34 may be carried out by cables to be welded, cables to be crimped, by means of dedicated connectors, etc. The second ends 38 of the conductive tracks 34, in use, may extend below the false ceiling panels 14 and can be used to establish the electrical connection of the fastening device 30 with a lighting device.

Figure 5:
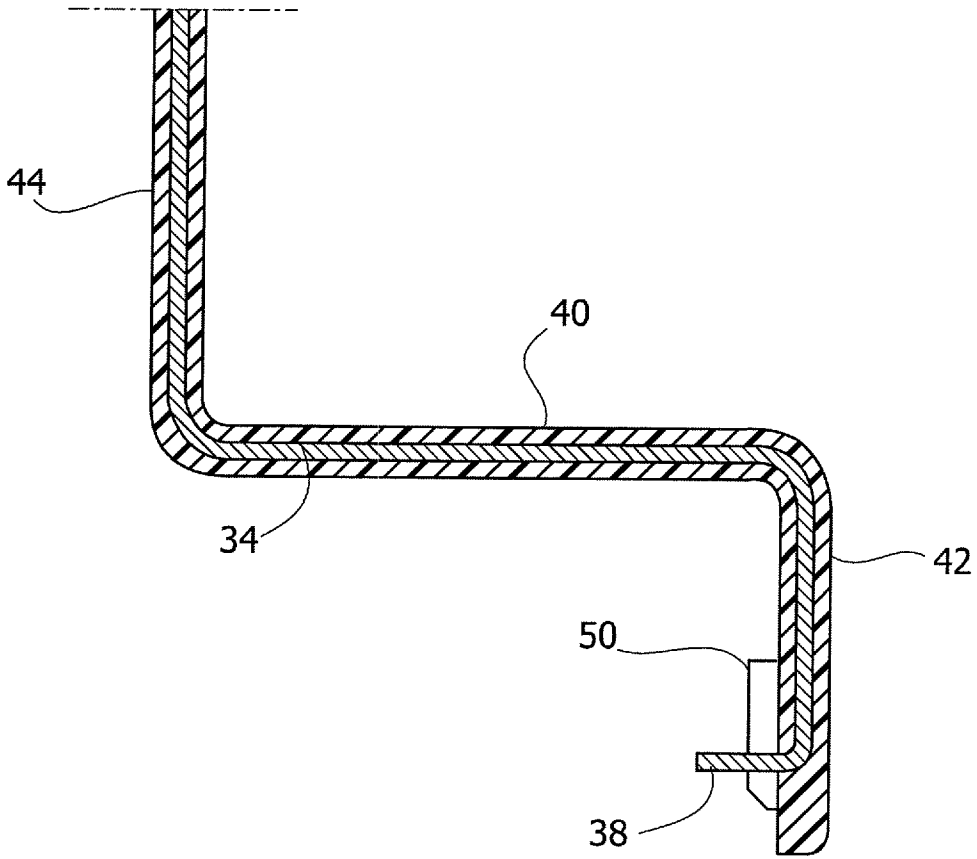
FIG. 5 is an enlarged detail of the part indicated by the arrow V in FIG. 4.

With reference to FIGS. 3, 4 and 5, in one or more embodiments the fastening device 30 may have a supporting portion 40 which, in use, is intended to rest on a portion of an upper surface 26 of a wing 20 of a T-shaped profile 12 of a false ceiling structure. In one or more embodiments, the device 30 may have a connecting portion 42, which can extend by 90° with respect to the supporting portion 40. In use, the connecting portion 42 can extend downwardly below the false ceiling panels 14, beyond the distal edge of a wing 20 of a T-shaped profile 12. In one or more embodiments, the fastening device 30 may comprise a supporting portion 44 which, in use, can rest against a portion of a central vertical rib 22 of a T-shaped profile 12. In one or more embodiments, the fastening device 30 may comprise an end portion 46 which, in use, can be arranged above the head 24 of a T-shaped profile 12. In one or more embodiments, the end portion 46 may have an end edge from which the first ends 36 of the conductive tracks 34 may protrude. In one or more embodiments, the fastening device 30 may have a diverted portion 48 located between the supporting portion 44 and the terminal portion 46 and laterally displaced with respect to the supporting portion 44 and with respect to the end portion 46. In use, the diverted portion 48 may be laterally displaced and without contact with respect to the head 24 of the T-shaped profile 12.

In one or more embodiments, the connecting portion 42 may have an engagement formation 50, formed, for example, by a projection of the body of plastic material 32 that, in use, can engage a complementary engagement formation formed on one side of a lighting device. In one or more embodiments, the second ends 38 of the conductive tracks 34 may extend perpendicularly to the connection formation 42.

In one or more embodiments, the portions 40, 42, 44, 46, 48 of the device 30 may be flat straight portions, for example, with a thickness of less than 1.5 mm.

Figure 6:
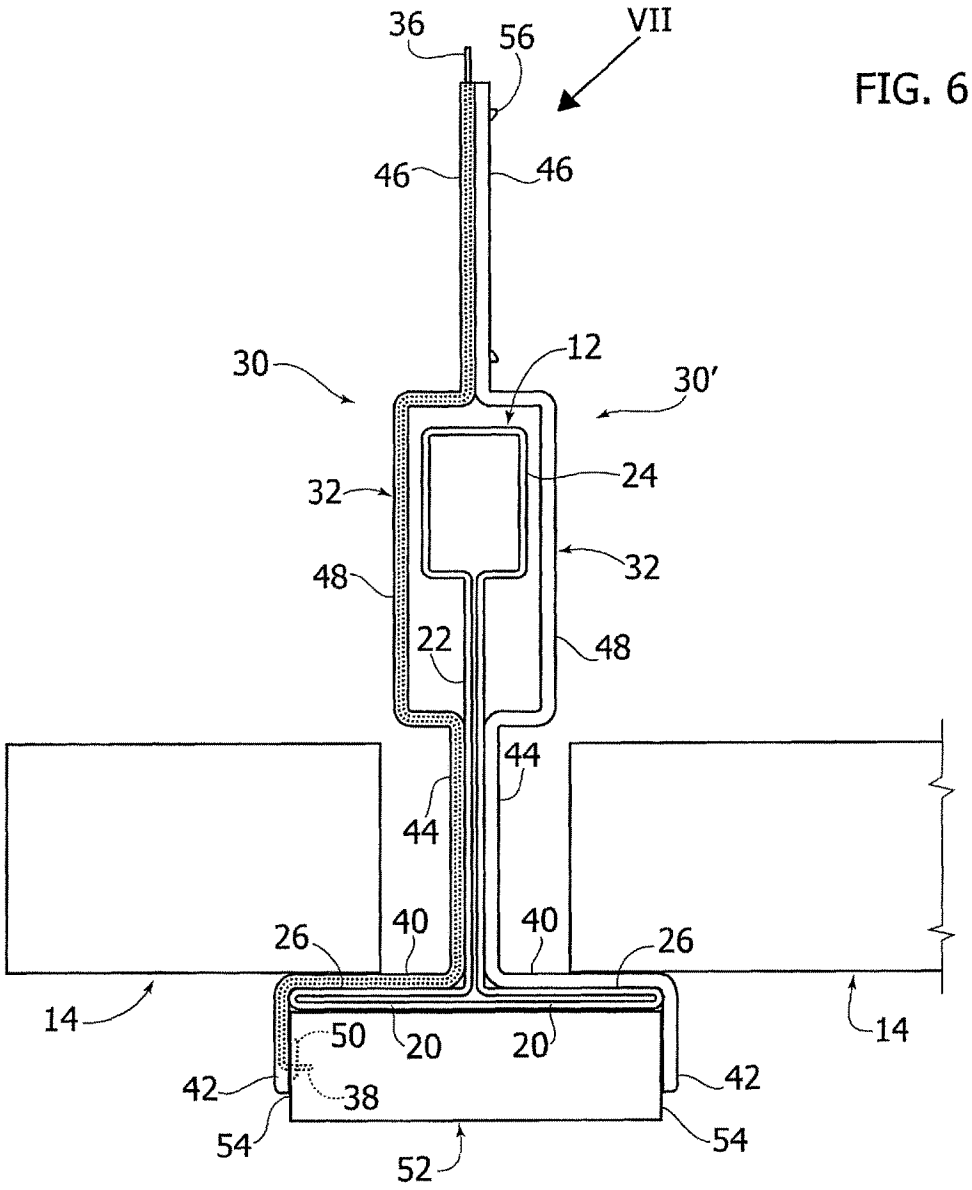
FIG. 6 is a cross-section illustrating a linear lighting device fastened to a T-shaped profile of a false ceiling structure, by means of two fastening devices.
Figure 7:
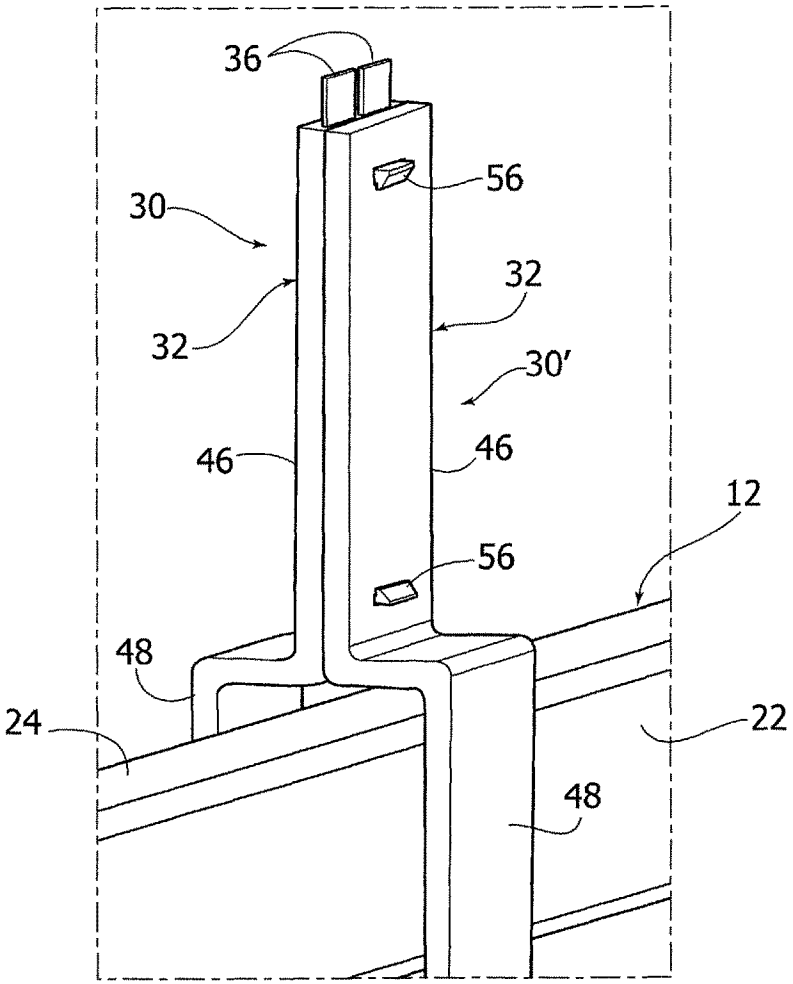
FIG. 7 is a perspective view of the part indicated by the arrow VII in FIG. 6, It will be appreciated that, for clarity and simplicity of illustration, the various figures may not be reproduced on the same scale.

With reference to FIG. 6, the reference number 52 indicates a linear lighting device 52. The lighting device 52 may include at least one source of electrically-powered light radiation. The lighting device 52 may use one or more sources of solid-state light radiation, for example LEDs, as the light radiation source. The linear lighting device 52, in use, may be in contact with the lower surface of the wings 20 of a T-shaped profile 12. The lighting device 52 can be fastened to the T-shaped profile 12 of the false-ceiling structure by means of a plurality of fastening devices 30. The connecting portion 42 of each fastening device 30 may be in contact with one side 54 of a linear lighting device 52.

The fastening devices 30 can be assembled alternately on opposite sides of the T-shaped profile 12, so that the connecting portions 42 of the fastening devices 30 are arranged alternately on opposite sides of the linear lighting device 52. The engagement formations 50 of the fastening devices 30 can engage complementary engagement formations formed on the sides 54 of the linear lighting device 52.

With reference to FIG. 6, in one or more embodiments a first fastening device 30 and a second fastening device 30' can be arranged facing each other at opposite sides of the T-shaped profile 12. In one or more embodiments, the second fastening device 30' may be without conductive tracks. In one or more embodiments, the two fastening devices 30, 30' arranged opposite each other can be fastened to each other. In one or more embodiments, the mutual fastening between the fastening devices 30, 30' arranged opposite each other can be carried out by means of snap-engagement formations, comprising, for example, elastic teeth 56 protruding from the first fastening device 30, which can snap-engage corresponding openings formed in the second fastening device 30'.

In one or more embodiments, the fastening devices 30, 30' located on opposite sides of the T-shaped profile 12 may be offset from one another along the longitudinal axis of the linear lighting device 52. At least one of the fastening devices 30 may be provided with conductive tracks having first ends 36 that can be electrically connected to an electrical power supply source, and second ends 38 that can be electrically connected to the linear lighting device 52.

As illustrated in FIG. 6, the ends of the false ceiling panels 14 may rest above the connecting portions 40 of the fastening devices 30, 30'. The edges of the false ceiling panels 14 can be raised with respect to the wings 20 of the T-shaped profiles 12 by a thickness equal to the thickness of the connecting portions 40 of the fastening devices 30, 30'. The thickness of the supporting portions 40 can be very thin (less than 1.5 mm), so that the effect of raising the edges of the false ceiling panels 14 can be substantially imperceptible.

One or more embodiments may have one or more of the following advantages:

- the mechanical fastening of the lighting devices to the supporting structure of the false ceiling and the electrical connection of the lighting devices can be carried out without replacing or modifying parts of the false ceiling structure, so that the installation can be simpler and faster,
- given that the thickness of the fastening devices can be very thin, the lifting effect of the edges of the false ceiling panels at the fastening devices can be very low (a 1.5 mm lift of the edges of the false ceiling panels is not visible by end-users and its effect on soundproofing of rooms is negligible),
- the fastening devices can be produced or painted with a color similar to the color of the false ceiling, so that the fastening devices can be perfectly integrated with the aesthetic appearance of the false ceiling,
- given that the end portions of the conductive tracks can be exposed, the installer can use the connection system he prefers for electrical connection of the fastening device to the electrical power supply source,
- the electrical insulation and the reliability of the insulation of the electrically conductive tracks can be ensured by the insulating covering of the fastening device (for example, of plastic material) and by the rigidity of the fastening device (the fastening device can be sufficiently rigid for preventing damage to the T-profiles and avoiding short-circuits).

One or more embodiments may, therefore, concern a fastening device (e.g. 30) for fastening lighting devices (e.g. 52) to T-shaped profiles (e.g. 12) of a false ceiling (e.g. 10), comprising a shaped flat body (e.g. 32) of electrically insulating material in which there are embedded conductive tracks (e.g. 34) having first and second ends (e.g. 36, 38) that protrude from opposite ends of said flat body (e.g. 32), wherein said conductive tracks (e.g. 34) are configured for establishing an electrical connection between a lighting device (e.g. 52) and a power supply source located above the false ceiling.

In one or more embodiments, the fastening device may comprise a supporting portion (for example, 40) which, in use, rests on an upper surface (e.g., 26) of a horizontal wing (e.g., 20) of a T-shaped profile (e.g. 12) of a false ceiling (e.g. 10).

In one or more embodiments, the fastening device may comprise a connecting portion (e.g. 42) which, in use, may protrude below the false ceiling (e.g. 10) beyond a distal edge of a wing (e.g. 20) of a T-shaped profile (e.g. 12) of a false ceiling (e.g. 10).

In one or more embodiments said second ends (e.g. 38) of said conductive tracks (e.g. 34) may protrude from said connecting portion (e.g. 42).

In one or more embodiments, said connecting portion (e.g. 42) may comprise an engagement formation (e.g. 50) which, in use, can engage a complementary engagement formation formed on one side (e.g. 54) of a lighting device (e.g. 52).

In one or more embodiments, the fastening device may comprise an end portion (for example, 46) from which said first ends (e.g., 36) of said conductive tracks (e.g., 34) may protrude.

In one or more embodiments, the fastening device may comprise a diverted portion (e.g. 48) which, in use, is displaced laterally relative to a head (e.g. 24) of a T-shaped profile (e.g. 12) of a false ceiling (e.g. 10).

One or more embodiments may concern a system for fastening lighting devices (e.g. 52) to T-shaped profiles (e.g. 12) of a false ceiling (e.g. 10), comprising at least one fastening device (e.g. 30) of the previously defined type.

In one or more embodiments, the fastening system can comprise a first and a second fastening device (for example 30, 30') arranged on opposite sides with respect to a T-shaped profile (e.g. 12).

In one or more embodiments said first and second fastening devices (e.g. 30, 30') can be offset from each other along a direction parallel to a longitudinal axis of a respective T-shaped profile (12).

In one or more embodiments, the fastening system may comprise a first fastening device (e.g. 30) provided with conductive tracks (e.g. 34) and a second fastening device (e.g. 30') without conductive tracks, arranged opposite each other on opposite sides of a T-shaped profile (e.g. 12) and fastened to each other by snap-engagement formations (e.g. 56).

Without prejudice to the underlying principles of the invention, the details of construction and the embodiments may vary, even significantly, with respect to those illustrated here, purely by way of non-limiting example, without departing from the scope of the invention.

This field of protection is defined by the attached claims.

LIST OF REFERENCE SIGNS false ceiling 10
T-shaped profiles 12
false ceiling panels 14
ceiling 16
suspension wires 18
horizontal wings 20
vertical central rib 22
upper heads 24
upper surfaces 26
fastening device 30
shaped flat body 32
electrically conductive tracks 34
first ends 36
second ends 38
supporting portion 40
connecting portion 42
supporting portion 44
terminal portion 46
diverted portion 48
engagement formations 50
linear lighting device 52
elastic teeth 56

The invention claimed is:

1. A fastening device for fastening lighting devices to T-shaped profiles of a false ceiling, comprising:

- a shaped flat body of electrically insulating material in which there are embedded conductive tracks having first and second ends that protrude from opposite ends of said flat body, wherein said conductive tracks are configured for establishing an electrical connection between a lighting device and a power supply source located above the false ceiling; and
- a connecting portion configured to protrude beneath the false ceiling beyond a distal edge of a wing of a T-shaped profile of the false ceiling; wherein the connecting portion comprises an engagement formation configured to engage a complementary engagement formation formed on one side of a lighting device.

2. A device according to claim 1, comprising a supporting portion configured to rest on an upper surface of a horizontal wing of a T-shaped profile of the false ceiling.

3. A device according to claim 1, wherein said second ends of said conductive tracks protrude from said connecting portion.

4. A device according to claim 1, comprising a terminal portion; wherein said first ends of said conductive tracks protrude from the terminal portion.

5. A device according to claim 4, comprising a diverted portion laterally displaced with respect to a head of a T-shaped profile of the false ceiling.

6. A system for fastening lighting devices to T-shaped profiles of the false ceiling comprising at least one fastening device according to claim 1.

7. A system according to claim 6, comprising a first fastening device and a second fastening device arranged on opposite sides of a T-shaped profile.

8. A system according to claim 7, wherein said first fastening device and second fastening device are offset from each other along a direction parallel to a longitudinal axis of a respective T-shaped profile.

9. A system according to claim 7, comprising a first fastening device provided with conductive tracks and a second fastening device without conductive tracks, arranged opposite each other on opposite sides of a T-shaped profile and fastened to each other by snap-engagement formations.

10. A fastening device for fastening lighting devices to T-shaped profiles of a false ceiling, comprising:

a shaped flat body of electrically insulating material in which there are embedded conductive tracks having first and second ends that protrude from opposite ends of said flat body, wherein said conductive tracks are configured for establishing an electrical connection between a lighting device and a power supply source located above the false ceiling;

a terminal portion; wherein said first ends of said conductive tracks protrude from the terminal portion; and a diverted portion laterally displaced with respect to a head of a T-shaped profile of the false ceiling.

11. A system for fastening lighting devices to T-shaped profiles of a false ceiling comprising:

a first fastening device comprising a shaped flat body of electrically insulating material in which there are embedded conductive tracks having first and second ends that protrude from opposite ends of said flat body, wherein said conductive tracks are configured for establishing an electrical connection between a lighting device and a power supply source located above the false ceiling; wherein the first fastening device comprises conductive tracks; and a second fastening device arranged on opposite sides of the T-shaped profile; wherein the second fastening device is without conductive tracks; and wherein the first fastening device and the second fastening device are fastened to each other by snap-engagement formations.

* * * * *